US007658580B1

(12) United States Patent
Conway et al.

(10) Patent No.: US 7,658,580 B1
(45) Date of Patent: Feb. 9, 2010

(54) TOILET BOLT COVER

(76) Inventors: Douglas E. Conway, 4896 Birch Church Rd., Oreana, IL (US) 62554; Russell L. Bodine, 410 Hackberry Dr., Decatur, IL (US) 62521

( * ) Notice: Subject to any disclaimer, the term of this patent is extended or adjusted under 35 U.S.C. 154(b) by 366 days.

(21) Appl. No.: 11/704,767

(22) Filed: Feb. 8, 2007

Related U.S. Application Data

(60) Provisional application No. 60/772,606, filed on Feb. 10, 2006.

(51) Int. Cl.
*F16B 37/14* (2006.01)
*A47G 3/00* (2006.01)

(52) U.S. Cl. ..... 411/374; 411/429

(58) Field of Classification Search ..... 411/372.5–374, 411/377, 429, 431, 66, 160, 161, 187
See application file for complete search history.

(56) References Cited

U.S. PATENT DOCUMENTS 628,297 A * 7/1899 Barr ..... 411/166
1,805,937 A * 5/1931 Berge ..... 411/372
1,994,978 A * 3/1935 Brown ..... 411/374
2,020,522 A * 11/1935 Seguin ..... 411/374
2,930,049 A * 3/1960 Minella ..... 4/417
3,241,427 A 3/1966 Bosler ..... 85/56
3,601,823 A 8/1971 Isaacs ..... 4/252
3,881,391 A * 5/1975 Dereszynski ..... 411/368
4,472,097 A * 9/1984 Kiefer et al. ..... 411/369
5,068,956 A * 12/1991 Malewicz ..... 29/437
5,181,817 A * 1/1993 Anderson ..... 411/369
5,653,564 A * 8/1997 Nakamura ..... 411/373
6,053,683 A 4/2000 Cabiran ..... 411/372.6
6,125,479 A 10/2000 Fraleigh ..... 4/252.1
6,126,355 A * 10/2000 Clover, Jr. ..... 403/13
6,698,986 B2 3/2004 Fraleigh ..... 411/301
6,808,350 B1 10/2004 Tooman et al. ..... 411/431
7,172,381 B2 * 2/2007 Miyazaki ..... 411/372.6

* cited by examiner

*Primary Examiner*—Flemming Saether
(74) *Attorney, Agent, or Firm*—Philip L. Bateman

(57) ABSTRACT

A toilet bolt cover hides the portion of a toilet bolt extending upwardly through a mounting hole in the toilet base along with a washer and a nut threaded upon the bolt. The cover includes a base and a cap. The base has a wall with external threads and the cap has internal threads. The base of the cover has a descending member that extends downwardly into the mounting hole in the toilet base to limit rotation of the base of the cover.

10 Claims, 5 Drawing Sheets

TOILET BOLT COVER

CROSS-REFERENCE TO RELATED APPLICATION

This application claims the benefit of U.S. Provisional Application Ser. No. 60/772,606, Feb. 10, 2006.

FIELD OF THE INVENTION

This invention relates to toilets. More particularly, this invention relates to covers for toilet bolts.

BACKGROUND OF THE INVENTION

A toilet is a standard fixture of indoor plumbing. A toilet is connected to a source of water and is mounted over a floor drain. As shown in FIGS. 1 and 2, a toilet is secured in position on the floor with two toilet bolts (sometimes known as T-bolts because of the shape of their heads) that extend upwardly from a closet flange at the mouth of the drain. The toilet contains oblong holes in its base that are placed over the bolts. The term "oblong" is used herein to refer to an elongated shape in which one dimension is greater than a perpendicular dimension. Washers and nuts are then inserted onto the bolts and tightened.

Exposed nuts and bolts are unsightly so they are typically hidden with a porcelain or plastic cover. As shown in FIG. 2, common practice is to use a cover consisting of a flat base that is placed onto the bolt under the washer and nut, and a cap that fits over the bolt and snaps onto the base. Toilet bolts are generally about 60 mm (about two and one-half inches) long to accommodate varying thicknesses of toilet bases and varying thicknesses of flooring. In many installations, the bolt is much longer than needed. In other words, the bolt extends above the toilet base by more than about 10 to 15 mm. Conventional bolt caps are not deep enough to fit over such a long bolt. As a result, it is frequently necessary to cut off the end of the bolt so that the cap will cover it and snap onto the disk. Cutting off the end of the bolt is a time-consuming and difficult procedure. Furthermore, if a different toilet with a thicker base is installed later, or if a thicker floor covering is added later, the cut-off bolt may not be long enough to attach a nut.

A variety of toilet bolt covers have been disclosed. Bosler, U.S. Pat. No. 3,241,427, Mar. 22, 1966, Isaacs, U.S. Pat. No. 3,601,823, Aug. 31, 1971, and Fraleigh, U.S. Pat. No. 6,698,986, Mar. 2, 2004, disclose toilet bolt caps that have internal receptacles for mating with the toilet bolt. These bolt caps do not contain a base and therefore do not form an effective seal around the bolt, nut, and washer. Tooman et al., U.S. Pat. No. 6,808,350, issued Oct. 26, 2004, disclose deep bolt caps that are installed on anchor bolts by pounding onto the nut and are held in place frictionally. The Tooman et al. caps also lack a base.

Cabiran, U.S. Pat. No. 6,053,683, Apr. 25, 2000, and Fraleigh, U.S. Pat. No. 6,125,479, Oct. 3, 2000, disclose bolt covers having caps with internal threads that mate with a base having external threads. The bases are relatively thick and the nut sits above all the threads. Accordingly, the base can be used only with bolts that extend relatively far above the toilet base. Furthermore, there is no means for preventing the base from rotating. Accordingly, removing the cap may be very difficult because the base tends to rotate with the cap.

Accordingly, there is a demand for an improved toilet bolt cover. More particularly, there is a demand for a toilet bolt cover that completely and securely seals the end of the toilet bolt, the nut, and the washer, that accommodates toilet bolts of varying lengths, and that is easily installed and easily removed.

SUMMARY OF THE INVENTION

The general object of this invention is to provide an improved toilet bolt cover. More particular objects are to provide a toilet bolt cover that completely and securely seals the end of the toilet bolt, the nut, and the washer, that accommodates toilet bolts of varying lengths, and that is easily installed and easily removed.

I have invented an improved toilet bolt cover for hiding the portion of a toilet bolt extending upwardly through a mounting hole in a toilet base together with a nut threaded upon the bolt. The cover comprises: (a) a base comprising: (i) a flat circular portion having a diameter of about 20 to 50 mm for providing sufficient space to allow a tool to fit onto the nut, the flat portion having a hole to accommodate the toilet bolt and having a descending member for extending downwardly into the mounting hole in the toilet base to limit rotation of the base; and (ii) a vertical cylindrical wall portion with external threads extending upwardly around the flat portion; and (ii) a vertical cylindrical wall portion with external threads extending upwardly around the circumference of the flat portion; and (b) a cap comprising: (i) a dome portion; and (ii) a cylindrical portion descending from the dome, the cylindrical portion having internal threads adapted to mate with the external threads of the base.

The toilet bolt cover of this invention completely and securely seals the end of the toilet bolt, the nut, and the washer. It accommodates toilet bolts of varying lengths. More particularly, it accommodates short bolts because the flat circular portion of the base is relatively thin and it accommodates long bolts because the cap is relatively deep. The cover is easily installed and easily removed for several reasons, including the base's descending member which prevents it from rotating.

DETAILED DESCRIPTION OF THE INVENTION

1. First Embodiment

Figure 1:
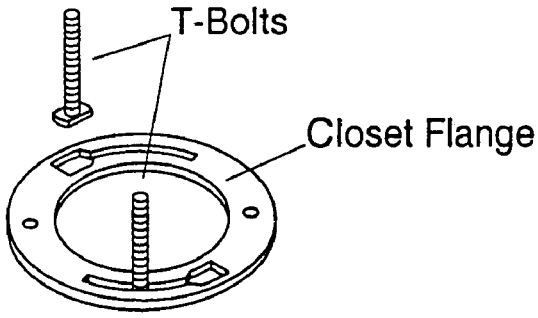
FIG. 1 (PRIOR ART)
FIG. 1 is a perspective view of a prior art closet flange and T-bolts.
Figure 2:
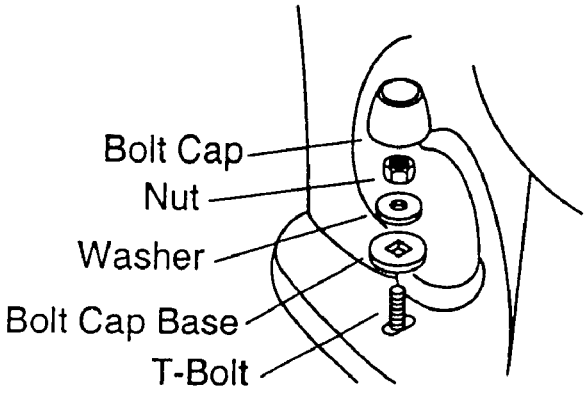
FIG. 2 (PRIOR ART)
FIG. 2 is a perspective view of a prior art toilet bolt cover.
Figure 3:
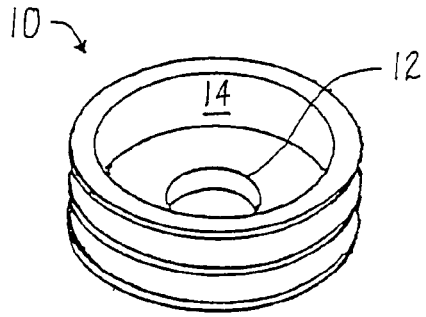
FIG. 3 is a top perspective view of the base of a first embodiment of the toilet bolt cover of this invention.
Figure 4:
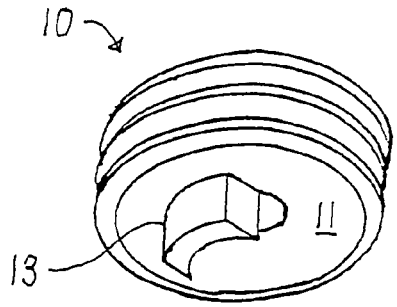
FIG. 4 is a bottom perspective view thereof.
Figure 5:
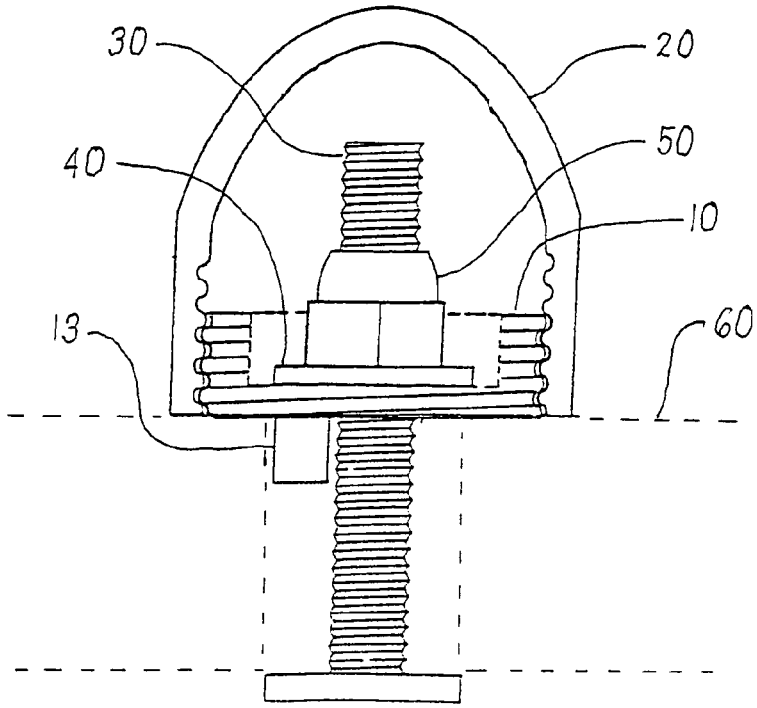
FIG. 5 is a partial sectional view of the first embodiment of the toilet bolt cover of this invention as installed.
Figure 6:
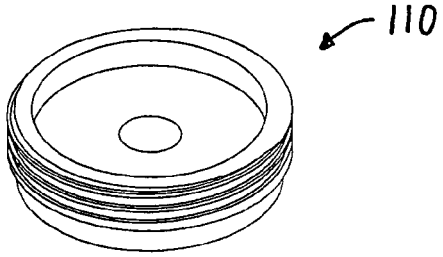
FIG. 6 is a top perspective view of the base of a second embodiment of the toilet bolt cover of this invention.
Figure 7:
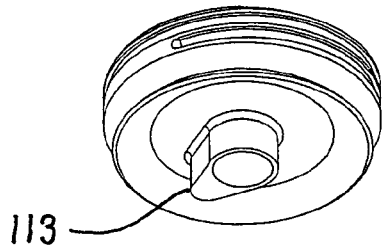
FIG. 7 is a bottom perspective view thereof.
Figure 8:
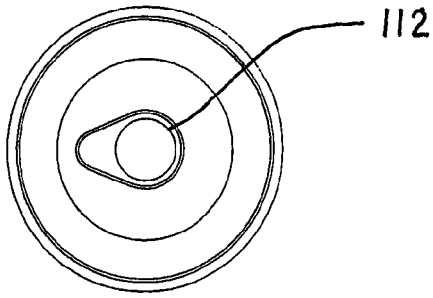
FIG. 8 is a bottom plan view thereof.
Figure 9:
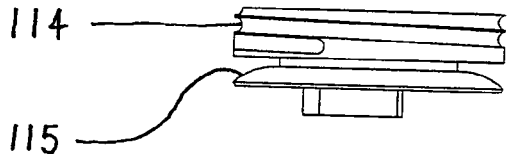
FIG. 9 is a front elevation view thereof.
Figure 10:
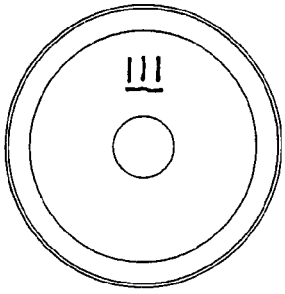
FIG. 10 is a top plan view thereof.
Figure 11:
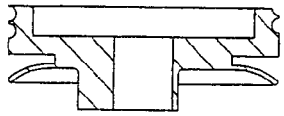
FIG. 11 is a sectional view thereof.
Figure 12:
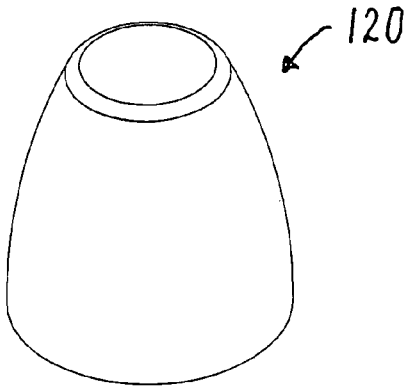
FIG. 12 is a top perspective view of the cap of the second embodiment of the toilet bolt cover of this invention.
Figure 13:
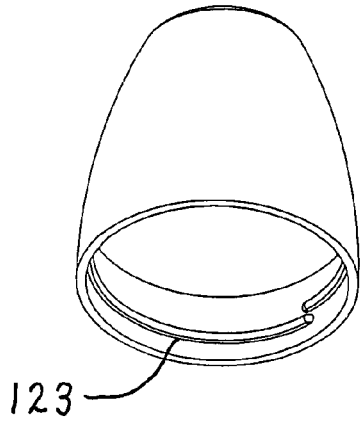
FIG. 13 is a bottom perspective view thereof.
Figure 14:
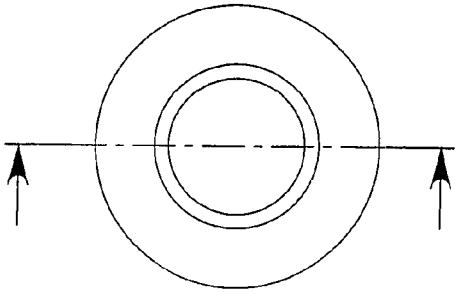
FIG. 14 is a top plan view thereof.
Figure 15:
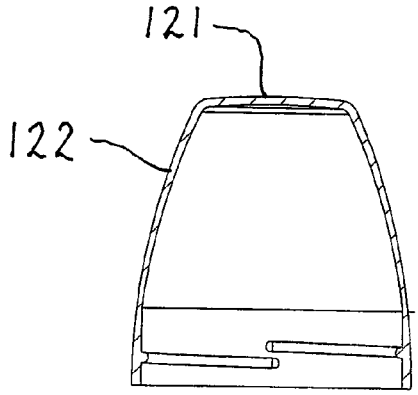
FIG. 15 is a sectional view thereof taken along the section of FIG. 14.

This invention is best understood by reference to the drawings. A first embodiment of the toilet bolt cover of this invention is shown in FIGS. 3 to 5. The cover comprises a base 10 and a cap 20. The cover hides from view the end of a toilet bolt 30, a washer 40, and a nut 50 that are used to mount a toilet 60. The base of the toilet is shown in phantom lines in FIG. 5.

The base of the cover has a disc portion 11 that rests on the upper surface of the toilet base. The disc portion is preferably round, flat, and as thin as possible to enable toilet bolts having the shortest length possible to be used. The ability to accommodate relatively short bolts is especially useful in retrofit applications where the bolt has previously been shortened. The disc portion generally has a thickness of about 1 to 10 mm, preferably about 2 to 5 mm. The disc portion has a centrally located hole 12 to accommodate the toilet bolt. The diameter of the hole is generally about 5 to 15 mm, preferably about 7 to 10 mm, or just slightly larger than the diameter of the bolt. As discussed below, the diameter of the disc portion is large enough to enable a tool to engage the nut on the toilet bolt but small enough to fit onto the base of the toilet. The diameter of the disc portion is generally about 20 to 50 mm, preferably about 30 to 40 mm.

A descending member 13 extends downwardly from the bottom of the disc portion along the hole. The descending member is oblong in shape and fits into the hole in the base of the toilet. The descending member preferably has a depth (height) of about 2 to 10 mm. The length and width of the descending member are small enough so that it fits within the hole in the toilet base and yet large enough so that it will engage the side of the hole in the toilet base and prevent the base from complete (360 degree) rotation. As discussed below, the cap is easily fastened and removed because the base cannot rotate completely.

A vertical cylindrical wall 14 extends upwardly around the perimeter of the disc portion. The wall and the flat portion thus define an interior space for the nut and washer. The wall has threads on its external surface. The threads are preferably relatively coarse so that the base and cap are attached easily and quickly without danger of cross-threading. The height of the wall is generally about 5 to 30 mm, preferably about 10 to 20 mm.

The cap has a size and shape to enable it to cover the bolt and to mate with the base. The cap is generally dome shaped with a top portion and a generally cylindrical portion descending from the top portion. The shape of the top portion is a matter of choice. A rounded top is aesthetically pleasing and easy to clean, but the top can also be flat, pyramidal, or the like. The cylindrical portion may be constant in diameter or may taper outwardly (increase slightly in diameter) from top to bottom. Internal threads in the cylindrical portion mate with the threads on the base. The cap generally has a diameter of about 20 to 50 mm, preferably about 30 to 40 mm. The cap generally has a height of about 20 to 50 mm, preferably about 30 to 40 mm, so that it can accommodate full length toilet bolts without cutting.

2. Second Embodiment

Figure 16:
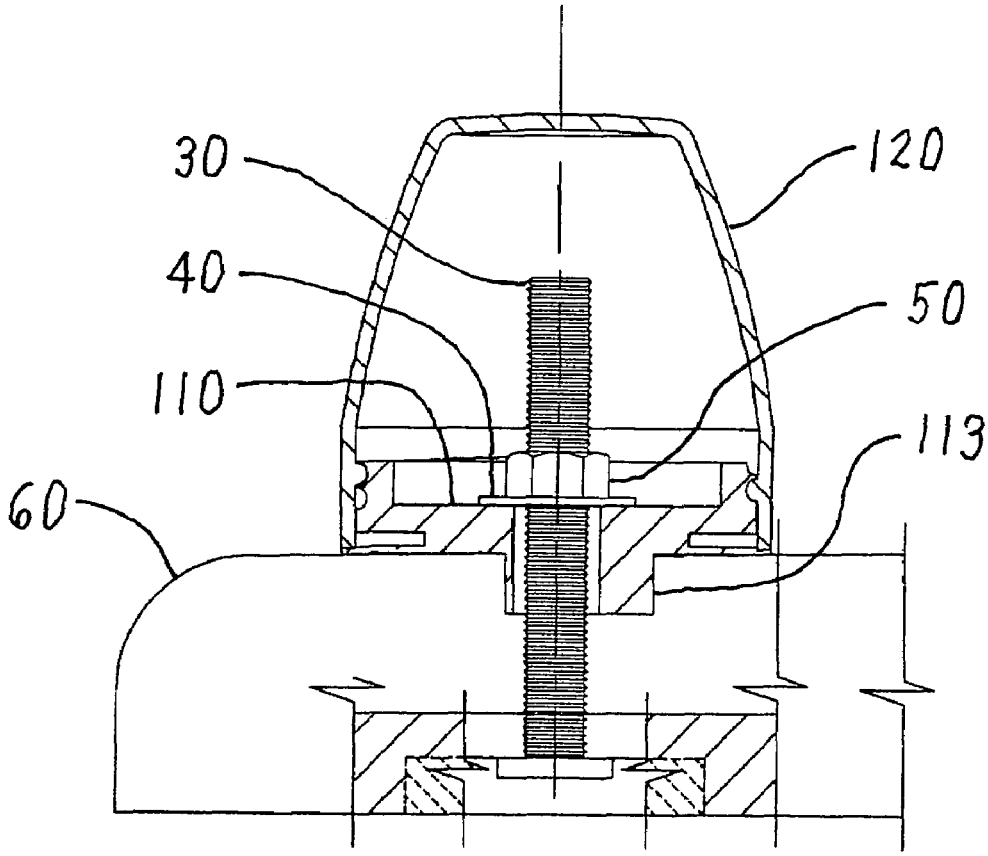
FIG. 16 is a partial sectional view of the second embodiment of the toilet bolt cover of this invention as installed.

A second embodiment of the toilet bolt cover is shown in FIGS. 6 to 16. The base 110 of the cover of this embodiment differs from the base of the first embodiment in two respects. First, the descending member 113 includes an integral sleeve that completely surrounds the hole for the bolt. The integral sleeve provides additional strength to the descending member and reduces the risk of breakage. Second, the base contains a flexible annular seal 115. The seal flattens against the top of the toilet base as the nut on the bolt is tightened. The purpose of the seal is to conform to, the top of the toilet base even if the top is not perfectly flat. The seal prevents liquids and materials from entering the hole in the base and thereby reduces odor and the growth of undesirable microorganisms. The diameter of the seal may be less than, equal to, or greater than the diameter of the cap. If the diameter of the seal is less than the diameter of the cap, the cap sits directly upon the base of the toilet. If the diameter of the seal is equal to or greater than the diameter of the cap as illustrated in FIG. 16, the cap sits upon the upper surface of the seal rather than directly upon the base of the toilet.

The cap 120 of the second embodiment also differs slightly from the cap of the first embodiment. First, it contains a flattened top 121 to reduce overall height. Second, its cylindrical portion 122 tapers outwardly from top to bottom. And third, it contains a single internal thread 123 that simplifies manufacture.

3. Materials

The base and the cap are made of a durable, attractive material that is impervious to water. Suitable materials include plastics, ceramics such as porcelain, and stainless steel. The base and cap are preferably made of plastic. Preferred plastics include the materials used to make conventional toilet bolt covers and include high density polyethylene, polyvinylchloride (PVC), and the like. The color is a matter of choice. White is universal but colors to match the toilet are also preferred for aesthetic reasons.

4. Installation

The installation and use of the toilet bolt cover of this invention can now be considered. After the toilet is placed over the drain with the bolts extending upwardly through the mounting holes in the base of the toilet, the base of the cover is placed over the bolt with the descending member extending into the mounting hole. A washer is then placed over the bolt so that it rests on the upper surface of the disc portion of the base of the cover. A nut is then threaded onto the bolt and tightened. The space between the nut and the wall of the base enables a tool such as a socket, wrench, pliers, or the like to be used for tightening the nut. The cap is then threaded down onto the base of the cover by hand until the cap contacts either the surface of the toilet base or the seal of the base (depending on the structure of the base). The cap thus completely hides all or most of the base from view. The threaded connection between the cap and the base is very secure and eliminates the danger of the cap being knocked off and lost. If desired at commercial, industrial, or institutional locations, security features are easily added to the cover to prevent removal of the cap without a key, special tool, or the like.

5. Advantages

As previously mentioned, the toilet bolt cover of this invention has many advantages over prior art covers. It can be appreciated that the toilet bolt cover works with a wide range of lengths of bolts. More particularly, the cover works with bolts that extend above the toilet base by about 5 to 50 mm. Accordingly, the cover works for retrofits with bolts that have previously been cut off. The cover also works for new installations with full-length bolts without the need to cut the bolt.

If the toilet needs to be removed or if the nuts need to be tightened, the cap is easily unscrewed from the base. There is no danger of the base rotating as the cap rotates because the descending member prevents rotation. The toilet bolt cover also provides an effective seal against liquids and other materials entering the toilet base hole or accumulating around the bolt, washer, and nut.

We claim:

1. A toilet bolt cover for hiding a toilet bolt extending upwardly through a mounting hole in a toilet base together with a toilet nut threaded upon the bolt, the cover comprising:

(a) a base comprising: (i) a fiat circular portion having a diameter of about 20 to 50 mm, the flat portion having a hole adapted to accommodate the toilet bolt and having a descending member adapted for extending downwardly into the mounting hole in the toilet base to limit rotation of the base, the flat circular portion forming a substantially flat lower surface adapted to rest flushly upon the toilet base except for the descending member; and (ii) a vertical cylindrical wall portion extending upwardly around the flat portion, the wall portion having an internal surface with an inner diameter greater than the nut providing sufficient space to allow a tool to fit onto the nut and having an external surface that contains threads; and (b) a cap comprising: (i) a dome portion; and (ii) a cylindrical portion descending from the dome, the cylindrical portion having internal threads adapted to mate with the threads on the external surface of the base.

2. The toilet bolt cover of claim 1 wherein the flat portion has a thickness of about 1 to 10 mm and a diameter of about 30 to 40 mm.

3. The toilet bolt cover of claim 2 wherein the base comprises a single descending member and wherein the descending member is oblong in shape.

4. The toilet bolt cover of claim 3 wherein the height of the wall portion of the base is about 5 to 30 mm.

5. The toilet bolt cover of claim 4 wherein the base additionally comprises a flexible annular flange.

6. A toilet bolt cover for hiding a portion of a toilet bolt extending upwardly through a mounting hole in a toilet base along with a nut threaded upon the bolt, the cover comprising:

(a) a base comprising: (i) a disc portion having a perimeter, a diameter of about 20 to 40 mm, a centrally located hole adapted to accommodate the toilet bolt, and an oblong descending member adapted for fitting within the mounting hole in the toilet base to limit rotation of the base, the disc portion forming a substantially flat lower surface adapted to rest flushly upon the toilet base except for the descending member; and (ii) a cylindrical wall extending vertically from the perimeter of the disc portion, the wall having an internal surface with an inner diameter greater than the nut providing sufficient space to allow a tool to fit onto the nut and having an external surface that contains threads;

(b) a cap comprising a dome having internal threads for mating with the external threads of the base.

7. The toilet bolt cover of claim 6 wherein the cap tapers outwardly.

8. The toilet bolt cover of claim 7 wherein the descending member includes an integral sleeve.

9. The toilet bolt cover of claim 8 wherein the base additionally comprises a flexible annular flange.

10. A toilet bolt cover for hiding a portion of a toilet bolt extending upwardly through a mounting hole in a toilet base along with a nut threaded upon the bolt, the cover comprising:

(a) a base comprising: (i) a disc portion having a perimeter, a diameter of about 20 to 40 mm, a centrally located hole adapted to accommodate the toilet bolt, and an oblong descending member with an integral sleeve adapted for fitting within the mounting hole in the toilet base to limit rotation of the base; (ii) a cylindrical wall with external threads extending vertically from the perimeter of the disc portion; and (iii) a flexible annular flange extending outwardly past the cylindrical wall of the base; and (b) an outwardly tapering cap comprising a dome having internal threads for mating with the external threads of the base and for sitting upon the flange.

* * * * *